US007323857B2

(12) United States Patent
Sung

(10) Patent No.: US 7,323,857 B2
(45) Date of Patent: Jan. 29, 2008

(54) CURRENT SOURCE WITH ADJUSTABLE TEMPERATURE COEFFICIENT

(75) Inventor: Kuang-Feng Sung, Taichung County (TW)

(73) Assignee: Novatek Microelectronics Corp., Hsinchu (TW)

( * ) Notice: Subject to any disclaimer, the term of this patent is extended or adjusted under 35 U.S.C. 154(b) by 59 days.

(21) Appl. No.: 11/309,054

(22) Filed: Jun. 14, 2006

(65) Prior Publication Data

US 2007/0210784 A1 Sep. 13, 2007

(30) Foreign Application Priority Data

Mar. 6, 2006 (TW) ..... 95107374 A

(51) Int. Cl.
*G05F 3/28* (2006.01)
*G05F 3/30* (2006.01)

(52) U.S. Cl. ..... 323/316

(58) Field of Classification Search ..... 323/311, 323/312, 315, 316; 327/568, 542, 543
See application file for complete search history.

(56) References Cited

U.S. PATENT DOCUMENTS 5,774,013 A * 6/1998 Groe ..... 327/543
6,124,754 A * 9/2000 Afghahi ..... 327/538

* cited by examiner

*Primary Examiner*—Gary L Laxton
(74) *Attorney, Agent, or Firm*—Jianq Chyun IP Office

(57) ABSTRACT

A current source with adjustable temperature coefficient is provided. The current source uses a first current generation unit and a second current generation unit to respectively produce a positive temperature coefficient current and a negative temperature coefficient current. A current addition unit is used to add the positive and negative temperature coefficient currents, and compose the positive and negative temperature coefficient currents according to a predetermined proportion. Finally, a reference current of adjustable temperature coefficient and value is output.

13 Claims, 2 Drawing Sheets

CURRENT SOURCE WITH ADJUSTABLE TEMPERATURE COEFFICIENT

CROSS-REFERENCE TO RELATED APPLICATION

This application claims the priority benefit of Taiwan application serial no. 95107374, filed on Mar. 6, 2006. All disclosure of the Taiwan application is incorporated herein by reference.

BACKGROUND OF THE INVENTION

1. Field of Invention

The present invention relates to a current source, and more particularly, to a current source circuit with an adjustable temperature coefficient.

2. Description of Related Art

Recently, in analog circuits, along with the progress of processes, the number of transistors contained in a unit area is increasingly larger, such that a large amount of thermal energy is generated during the operation of the circuit, and thus the temperature of circuit will also rise dramatically. Due to the rising temperature, properties of many elements in analog circuit will change, thus the performance of circuit becomes worse. For example, differential pairs frequently appear in analog circuits are connected by sources of two transistors, and the two transistors are driven by a bias current. When the bias current changes due to the variation of temperature, both voltage gain and noise of the differential pair circuit are affected. Therefore, it is desirable to use a reference circuit in analog circuit to generate stable and temperature-free bias current.

Similarly, an operationally stable and temperature-free reference potential is also desired to define the overall range of the input or output potential in analog-to-digital (A/D) converters and digital-to-analog (D/A) converters.

To obtain a stable reference potential not subject to temperature variation, a positive temperature coefficient voltage must be used to compensate a negative temperature coefficient voltage, for example, FIG. 1A illustrates a simplified circuit diagram of a conventional bandgap voltage reference circuit. In FIG. 1A, the base-emitter voltage $V_{BE}$ of ambipolar transistor Q is a negative temperature coefficient voltage. This circuit uses voltage directly proportional to absolute temperature to multiply K and then compensates the negative temperature coefficient $V_{BE}$, and a zero temperature coefficient voltage $V_{ref}$ is output after addition.

FIG. 1B is an actual layout of the conventional circuit of FIG. 1A, which comprises ambipolar transistors Q1, Q2, Q3, resistors R1, R2, a P-type MOS transistor M3, and current mirrors 10 and 20, wherein the current mirror 10 includes identical P-type MOS transistors M1-M2, and the current mirror 20 includes identical N-type MOS transistors M4-M5. Two identical currents generated by the current mirrors 10 and 20 respectively flow into Q1 and Q2, and the voltages at nodes P1, P2 are identical.

If the base-emitter voltage of ambipolar transistor Q1 is represented as $V_{BE1}$, and the base-emitter voltage of ambipolar transistor Q2 is represented as $V_{BE2}$, the voltage drop between the two ends of resistor R1 is $V_{BE1}-V_{BE2}$, and it is learnt from the physical property of ambipolar transistor that $V_{BE1}-V_{BE2}$ is a positive temperature coefficient voltage, thus the current flowing through R1 is a positive temperature coefficient current. Moreover, a current mirror structure is formed by using P-type MOS transistors M2, M3, so as to replicate current of resistor R1 to resistor R2, thus the voltage drop between the two ends of resistor R2 is a positive temperature coefficient voltage. Since the base-emitter voltage of the ambipolar transistor Q3 is a negative temperature coefficient voltage and the emitter of the ambipolar transistor Q3 and the resistor R2 are electrically connected, positive and negative temperature coefficient voltages compensate each other, so as to output a zero temperature coefficient voltage $V_{ref}$.

Conventionally, the output zero temperature coefficient voltage $V_{ref}$ of the bandgap voltage reference circuits tends to be limited to approximate 1.2 volts. If other voltages are preferable, voltage division or other methods must be employed. If a temperature-irrelevant current is desired, and the zero temperature coefficient voltage output by the bandgap voltage reference circuit must be driven by a resistor to generate a zero temperature coefficient current, which makes the circuit become more complicated. The addition of a resistor again results in a further expansion of circuit area and reduces the competitiveness of the integrated circuit.

SUMMARY OF THE INVENTION

Accordingly, an object of the present invention is to provide a current source with adjustable temperature coefficient, so as to generate a current with adjustable value and temperature coefficient.

The present invention provides a current source with adjustable temperature coefficient for generating an output current with a specific temperature coefficient. The current source comprises a first current generation unit, a second current generation unit, and a current addition unit. The first current generation unit is used for generating a first current with a positive temperature coefficient. The second current generation unit is used for generating a second current with a negative temperature coefficient. The current addition unit is coupled to the first and second current generation units to compose the first and second currents according to a predetermined proportion, so as to generate an output current with a specific temperature coefficient. Wherein, the temperature coefficient of the output current is determined by adjusting the predetermined proportion.

Because the positive and negative temperature coefficient currents are added according to a certain proportion in the present invention, a current source with adjustable value and temperature coefficient is generated, and a voltage with adjustable value and temperature coefficient is produced through the driving of the current.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
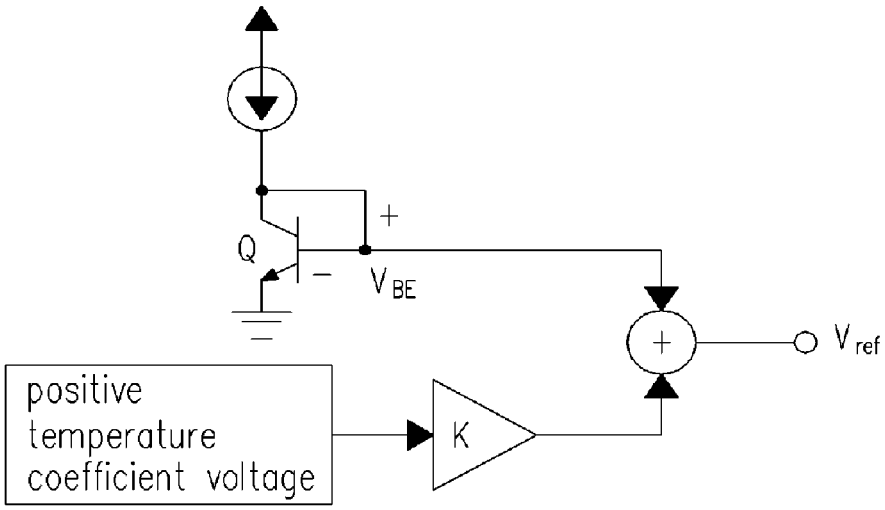
FIG. 1A (PRIOR ART)
FIG. 1A is a simplified circuit diagram of a conventional bandgap voltage reference circuit.
Figure 1B:
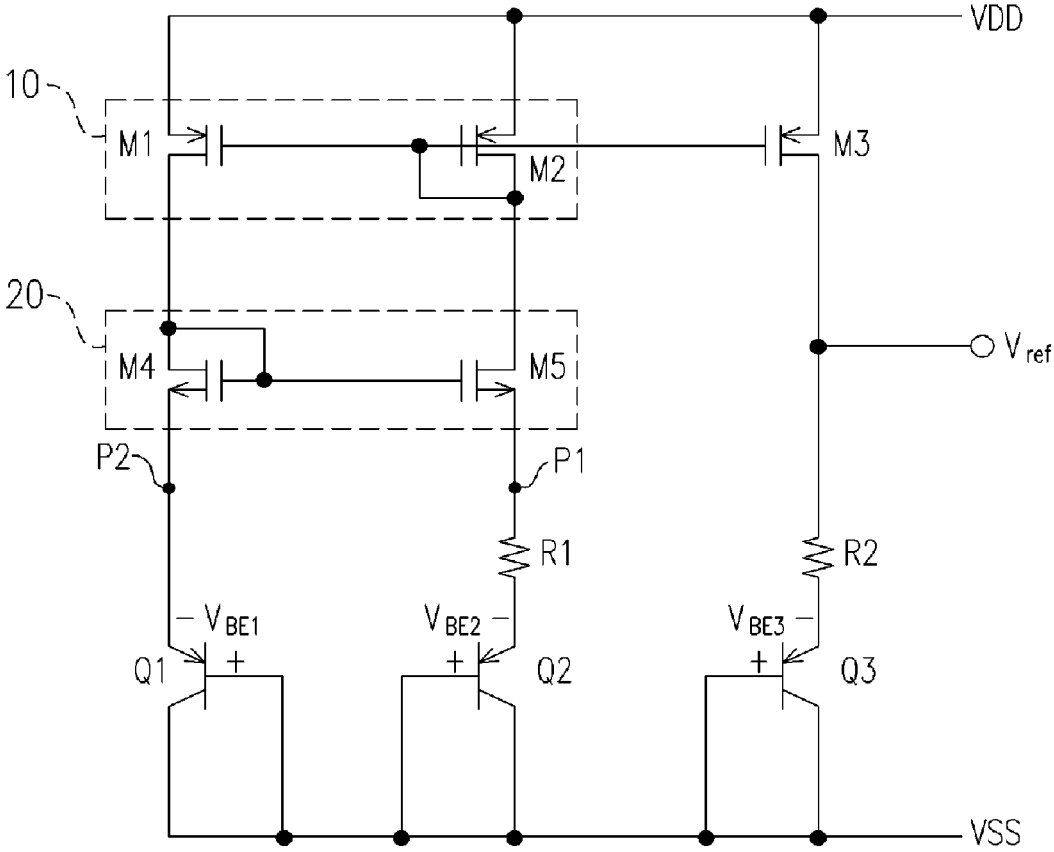
FIG. 1B (PRIOR ART)
FIG. 1B is a circuit diagram of a conventional bandgap voltage reference circuit.
Figure 2:
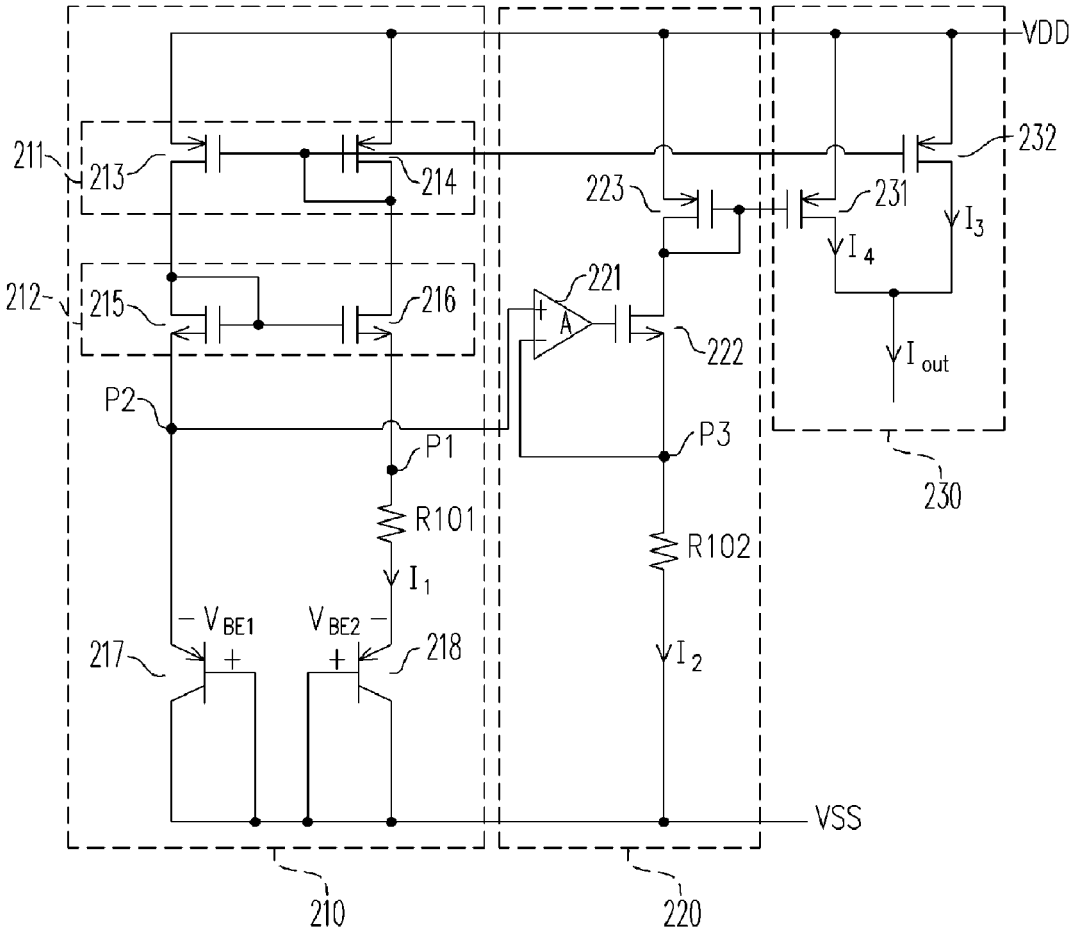
FIG. 2 is a circuit diagram of a current source with adjustable temperature coefficient according to a preferred embodiment of the present invention.

FIG. 2 is a circuit diagram of a current source with an adjustable temperature coefficient according to an embodiment of the present invention, which comprises a first current generation unit 210, a second current generation unit 220, and a current addition unit 230. The first current generation unit 210 is used for generating a current with a positive temperature coefficient. The second current generation unit 220 is used for generating a current with a negative temperature coefficient. The current addition unit 230 is coupled to the first and second current generation units 210, 220 for composing the positive and negative temperature coefficient currents according to a predetermined proportion, so as to output a current with a specific temperature coefficient.

The first current generation unit 210 includes a first current mirror 211, a second current mirror 212, a first resistor R101, a first transistor 217, and a second transistor 218. In the embodiment, transistors 217 and 218 are implemented, for example, by PNP ambipolar transistors.

The first current mirror 211 has first and second ends on the primary side, and first and second ends on the subordinate side. In the embodiment, the first current mirror 211 consists of fifth and sixth transistors 213, 214, wherein the transistors 213, 214 are implemented, for example, by P-type MOS transistors. A source and a drain of the transistor 213 are respectively the first and second ends on the subordinate side of the first current mirror 211, and a source and a drain of the transistor 214 are respectively the first and second ends on the primary side of the first current mirror 211. A gate of the transistor 213 is electrically connected to a gate and the drain of the transistor 214, and the sources of transistors 213, 214 are connected to a first system voltage VDD.

Similarly, the second current mirror 212 has the same construction as the first current mirror 211. In the embodiment, the second current mirror 212 consists of transistors 215 and 216 implemented, for example, by N-type MOS transistors. Moreover, a drain and a source of the transistor 215 are respectively the first and second ends on the primary side of the second current mirror 212, and a drain and a source of the transistor 216 are respectively the first and second ends on the subordinate side of the second current mirror 212. A gate of the transistor 216 is electrically connected to a gate and the drain of the transistor 215, and drains of the transistors 215 and 216 are respectively connected to the drains of the transistors 213 and 214.

The source of the transistor 216 is electrically connected to the first end of the resistor R101. The second end of the resistor R101 is electrically connected to an emitter of the transistor 218. The source of the transistor 215 is electrically connected to an emitter of the transistor 217. Both bases and collectors of the transistors 217, 218 are electrically connected to a second system voltage VSS.

The first current mirror 211 generates a stable first current $I_1$ irrelevant to the first system voltage VDD flowing into the transistors 217 and 218 together with the second current mirror 212. The voltage at a node P1 (a first internal voltage) and the voltage at a node P2 (a second internal voltage) are almost identical.

If the base-emitter voltage of the transistor 217 is represented as $V_{BE1}$, and the base-emitter voltage of the transistor 218 is represented as $V_{BE2}$, it is learnt from the physical property of the transistor that the collector current of the transistor 217 $I_C=I_S\exp(V_{BE1}/V_T)$, while $V_{BE1}=V_T\ln(I_C/I_s)$, wherein $V_T$ is the thermal voltage, $I_s$ is the saturation current. In this embodiment, because currents flowing into the transistors 217 and 218 have the same value, if base current is ignored, the collector currents of the transistors 217 and 218 are both about $I_1$. Furthermore, since the transistors 217 and 218 are two separate transistors, and the junction area of the transistor 218 is N times that of the transistor 217, the saturation current of the transistor 218 is N times that of the transistor 217. Therefore, the base-emitter voltage difference between the transistors 217, 218 is $V_{BE1}-V_{BE2}=V_T\ln(I_1/I_S)-V_T\ln(I_1/N_{IS})=V_T\ln(N)$.

Due to the physical property of the transistor, it is known that the thermal voltage $V_T$ is a positive temperature coefficient voltage, thus $V_{BE1}-V_{BE2}$ is a positive temperature coefficient voltage as well. And since the voltages at the nodes P1 and P2 are almost identical, the voltage between the two ends of the resistor R101 is exactly $V_{BE1}-V_{BE2}$, and the voltage drop between the two ends of the resistor R101 drives to generate the current $I_1$. Therefore, the current $I_1$ is a positive temperature coefficient current.

The second current source generator 220 includes an operational amplifier 221, a third transistor 222, a fourth transistor 223, and a second resistor R102. In the embodiment, the transistor 222 is implemented by an N-type MOS transistor, and the transistor 223 is implemented by a P-type MOS transistor.

A first input end (for example, the positive input end) of the operational amplifier 221 is electrically connected to the source of the transistor 215 for receiving the voltage at the node P2. A gate of the transistor 222 is electrically connected to an output end of the operational amplifier, and a source of the transistor 222 is electrically connected to a second input end (for example, the negative input end) of the operational amplifier and to a first end of the resistor R102. A second end of the resistor R102 is electrically connected to the second system voltage VSS. A source of transistor 223 is electrically connected to the first system voltage VDD, a gate and a drain of which are electrically connected to the drain of transistor 222.

A voltage replicator is constructed via the operational amplifier 221 and the transistor 222, and the voltage at the node P3 (a third internal voltage) gains compensation and therefore is identical to the voltage at the node P2. The resistor R102 is driven by the voltage at the node P3 so as to generate a second current $I_2$. The node P2 is electrically connected to the emitter of the transistor 217, and it is known from the physical property of the transistor that the base-emitter voltage of the transistor drops while the temperature rises, thus the voltages at the nodes P2, P3 are negative temperature coefficient voltages. Therefore, the current $I_2$ is a negative temperature coefficient current.

Comparing this embodiment with the bandgap voltage reference circuit of the conventional art, the conventional circuit directly compensates the negative temperature coefficient base-emitter voltage of the transistor with the positive temperature coefficient voltage, so as to generate a zero temperature coefficient voltage. The present invention designs a second current generation unit 220 to produce a negative temperature coefficient current $I_2$, the value of which is adjusted by the resistor R102, and which thus is more flexible than the conventional art.

The current addition unit 230 includes a first current generator and a second current generator. The first current $I_1$ is amplified through the first current generator according to a certain proportion so as to output a third current $I_3$. The second current $I_2$ is amplified through the second current generator according to a certain proportion so as to output a fourth current $I_4$. In the embodiment, the first current generator is implemented by an eighth transistor 232, for example, a P-type MOS transistor, and the second current generator is implemented by a seventh transistor 231, for example, a P-type MOS transistor.

A gate of the transistor 231 is electrically connected to the gate of the transistor 223. A source of the transistor 231 is electrically connected to the first system voltage VDD. The transistors 231 and 223 constitute a current mirror structure, and the current $I_2$ is amplified by the use of a ratio of width to length of transistor channel and other element properties according to a predetermined proportion, and the current $I_4$ is output by the drain of the transistor 231. It can be known from the above that the current $I_2$ is a negative temperature coefficient current, thus $I_4$ is also a negative temperature coefficient current.

A gate of the transistor 232 is electrically connected to the gate of the transistor 214. A source of the transistor 232 is electrically connected to the first system voltage VDD. Furthermore, the transistors 232 and 214 constitute a current mirror structure, and the current $I_1$ is amplified by the use of a ratio of width to length of transistor channel and other element properties according to a predetermined proportion, and the current $I_3$ is output by the drain of the transistor 232. It can be known from the above that the current $I_1$ is a positive temperature coefficient current, thus $I_3$ is also a positive temperature coefficient current.

And a drain of the transistor 231 is electrically connected to a drain of the transistor 232, thus the positive temperature coefficient current $I_3$ and the negative temperature coefficient current $I_4$ are added and composed to output an output current $I_{out}$ with an adjustable temperature coefficient and value.

From the above circuit structure, it is known that the current addition unit 230 outputs the current $I_{out}$, and the temperature coefficient and value of the output current $I_{out}$ are determined by adjusting the proportion between the third current $I_3$ and the fourth current $I_4$. For example, the magnification of the currents $I_1$ and $I_2$ is adjusted by adjusting the ratio of width to length of the transistor channel and other element properties, or the values of $I_1$ and $I_2$ are adjusted directly through the resistors R101 and R102. Thus, different methods of adjustment may be used to accommodate different processes, making circuits more flexible in design.

If a reference voltage with an adjustable temperature coefficient and value is to be achieved with the present invention, the aforementioned methods can be used to combine a current with an adjustable temperature coefficient and value (for example, the output current $I_{out}$ in FIG. 2) with a resistant element (for example, a resistor or a transistor resistor), so as to establish a reference voltage. Therefore, a reference voltage with an adjustable temperature coefficient and value is output by adjusting the resistance of the resistant element or by adjusting the output current $I_{out}$ with the aforementioned methods (adjusting ratio of width to length of transistor channel or adjusting the resistance of resistors). Moreover, because the value of the reference voltage is no longer limited to the conventional 1.2 volt, circuits for voltage division are omitted, such that the overall circuit structure becomes simpler and the consumed current is further decreased.

Although preferred embodiments have been used to disclose the present invention as the above, they are not intended to limit it. For any one skilled in the art, a few variations and modifications can be made without departing from the spirit and scope of the present invention. Thus, what is defined in the accompanying claims must be regarded as the criterion for the protective range of the present invention.

What is claimed is:

1. A current source with adjustable temperature coefficient, for generating an output current with a specific temperature coefficient, comprising:

a first current generation unit, for generating a first current with a positive temperature coefficient;

a second current generation unit, having a voltage replicator and a second resistor, for generating a second current with a negative temperature coefficient; and a current addition unit, coupled to the first and second current generation units, for composing the first and second currents according to a first predetermined proportion, so as to generate an output current with the specific temperature coefficient, wherein the temperature coefficient of the output current is determined by adjusting the first predetermined proportion.

2. The current source with adjustable temperature coefficient as claimed in claim 1, wherein the first current generation unit further generates a first internal voltage with a positive temperature coefficient, and the first current generation unit comprises:

a first resistor, for determining the first current passing through the first resistor according to the first internal voltage.

3. The current source with adjustable temperature coefficient as claimed in claim 2, wherein the first current generation unit further comprises:

a first current mirror, having a first end and a second end on a primary side and a first and a second end on a subordinate side, wherein the first ends on the primary and subordinate sides of the first current mirror are connected to a first system voltage;

a second current mirror, having a first end and a second end on the primary side and a first end and a second end on the subordinate side, wherein the first end on the primary side of the second current mirror is connected to the second end on the subordinate side of the first current mirror, the first end on the subordinate side of the second current mirror is connected to the second end on the primary side of the first current mirror, the second end on the subordinate side of the second current mirror is electrically connected to the first end of the first resistor, and the second end on the primary side of the second current mirror generates a second internal voltage with a negative temperature coefficient;

a first transistor, having an emitter electrically connected to the second end on the primary side of the second current mirror, and a base and a collector electrically connected to a second system voltage; and a second transistor, having an emitter electrically connected to the second end of the first resistor, and a base and a collector electrically connected to the second system voltage.

4. The current source with adjustable temperature coefficient as claimed in claim 3, wherein the voltage replicator has an input end electrically connected to the second end on the primary side of the second current mirror, for receiving the second internal voltage, and replicating the second internal voltage according to a second predetermined proportion and outputting it as a third internal voltage; and the second resistor is electrically connected to the voltage replicator, for determining the second current passing through the second resistor according to the third internal voltage output by the voltage replicator.

5. The current source with adjustable temperature coefficient as claimed in claim 4, wherein the voltage replicator comprises:

an operational amplifier, having a first input end electrically connected to the second end on the primary side of the second current mirror, for receiving the second internal voltage; and a third transistor, having a gate electrically connected to an output end of the operational amplifier, a source electrically connected to a second input end of the operational amplifier and to the first end of the second resistor, wherein the source voltage of the third transistor is the third internal voltage; and the second current generation unit further comprises:

a fourth transistor, having a source electrically connected to the first system voltage, and a gate and a drain electrically connected to a drain of the third transistor.

6. The current source with adjustable temperature coefficient as claimed in claim 5, wherein the first current mirror comprises:

a fifth transistor, having a source and a drain respectively being the first and second ends on the subordinate side of the first current mirror; and a sixth transistor, having a source and a drain respectively being the first and second ends on the primary side of the first current mirror, and a gate electrically connected to the gate of the fifth transistor and to the drain of the sixth transistor.

7. The current source with adjustable temperature coefficient as claimed in claim 6, wherein the current addition unit comprises:

a seventh transistor, having a gate electrically connected to the gate of the fourth transistor, a source electrically connected to the first system voltage, and a drain outputting a third current; and an eighth transistor, having a gate electrically connected to the gate of the sixth transistor, a source electrically connected to the first system voltage, and a drain electrically connected to the drain of the seventh transistor, wherein the drain of the eighth transistor outputs a fourth current;

wherein the sum of the third and fourth currents is the output current.

8. The current source with adjustable temperature coefficient as claimed in claim 1, wherein the current addition unit comprises:

a first current generator, electrically connected to the first current generation unit, for outputting a third current according to the first current; and a second current generator, electrically connected to the second current generation unit, for outputting a fourth current according to the second current;

wherein the first predetermined proportion is determined by adjusting the proportion between the first current and the third current, as well as the proportion between the second current and the fourth current; and the current addition unit outputs the third and fourth currents in parallel as the output current.

9. A method of generating an output current with a specific temperature coefficient, comprising:

making a current source pass through a first transistor and a second transistor, wherein the first transistor has a first base-emitter voltage and the second transistor has a second base-emitter voltage, and converting the difference between the first and second base-emitter voltages into a first current;

applying the first base-emitter voltage via a voltage replicator to a first impedor so as to generate a second current;

amplifying the first current by a first magnification as a third current;

amplifying the second current by a second magnification as a fourth current; and adding the third and fourth currents to generate the output current with a specific temperature coefficient.

10. The method of generating an output current with a specific temperature coefficient as claimed in claim 9, wherein the first and second transistors have different junction areas.

11. The method of generating an output current with a specific temperature coefficient as claimed in claim 9, wherein the step of converting the difference between the first and second base-emitter voltages into the first current is bridging the first and second base-emitter voltages over a second impedor to generate the first current.

12. The method of generating an output current with a specific temperature coefficient as claimed in claim 9, wherein the first current is a positive temperature coefficient current, and the second current is a negative temperature coefficient current.

13. The method of generating an output current with a specific temperature coefficient as claimed in claim 9, wherein a specific temperature coefficient is obtained by adjusting the proportion between the first magnification and the second magnification.

* * * * *